US008801371B2

(12) United States Patent
Kreiselmaier et al.

(10) Patent No.: US 8,801,371 B2
(45) Date of Patent: Aug. 12, 2014

(54) GAS TURBINE

(75) Inventors: Erich Kreiselmaier, Stetten (CH); Chiara Zambetti, Baden (CH); Thomas Wilhelm, Zürich (CH)

(73) Assignee: Alstom Technology Ltd., Baden (CH)

( * ) Notice: Subject to any disclaimer, the term of this patent is extended or adjusted under 35 U.S.C. 154(b) by 478 days.

(21) Appl. No.: 13/116,523

(22) Filed: May 26, 2011

(65) Prior Publication Data

US 2011/0293402 A1 Dec. 1, 2011

(30) Foreign Application Priority Data

May 27, 2010 (EP) ..... 10164084

(51) Int. Cl.
*F01D 5/20* (2006.01)

(52) U.S. Cl.
USPC ..... 415/173.1; 415/116

(58) Field of Classification Search
USPC ..... 415/173.4, 173.5, 173, 6, 176
See application file for complete search history.

(56) References Cited

U.S. PATENT DOCUMENTS

| | | | | |
|---|---|---|---|---|
| 4,161,318 | A * | 7/1979 | Stuart et al. | 277/431 |
| 6,171,052 | B1 | 1/2001 | Aschenbruck et al. | |
| 6,641,363 | B2 * | 11/2003 | Barrett et al. | 415/116 |
| 6,742,783 | B1 * | 6/2004 | Lawer et al. | 277/416 |
| 2002/0085909 | A1 | 7/2002 | Bekrenev | |
| 2004/0090013 | A1 | 5/2004 | Lawer et al. | |
| 2004/0258523 | A1 | 12/2004 | Naik et al. | |
| 2004/0265120 | A1 | 12/2004 | Tuffs et al. | |
| 2009/0214328 | A1 | 8/2009 | Tibbott et al. | |
| 2010/0119357 | A1 | 5/2010 | Haller | |
| 2010/0189542 | A1 | 7/2010 | Maltson | |

FOREIGN PATENT DOCUMENTS

| | | | |
|---|---|---|---|
| DE | 101 56 193 | A1 | 6/2003 |
| EP | 0 957 237 | A2 | 11/1999 |
| EP | 1 213 444 | A2 | 6/2002 |
| EP | 1 219 788 | A2 | 7/2002 |
| EP | 1 788 195 | A2 | 5/2007 |
| EP | 2 009 248 | A1 | 12/2008 |
| FR | 2 384 949 | A1 | 10/1978 |
| GB | 2 446 149 | A | 8/2008 |
| WO | WO 03/054359 | A1 | 7/2003 |

OTHER PUBLICATIONS

Search Report issued on Nov. 5, 2010, by European Patent Office for Application No. 10164084.5.

* cited by examiner

*Primary Examiner* — Nathaniel Wiehe
*Assistant Examiner* — Michael Sehn
(74) *Attorney, Agent, or Firm* — Buchanan Ingersoll & Rooney PC

(57) ABSTRACT

A gas turbine including an inner casing and a rotor having rotatable blades with a shroud and a fin, and a cooling arrangement arranged in a cavity in the casing and about the rotatable blade. The blade shroud includes a protrusion extending away from the blade leading edge into the cavity and openings in the cavity wall for a cooling fluid. The protrusion is defined by angles in relation to the flow channel wall. The protrusion affects a vortex flow of cooling fluid entering through the openings and a vortex flow of hot gas entering from the flow channel into the cavity. The double-vortex formation reduces a mixing of the cooling flow with the hot gas flow and increases the efficiency of the cooling arrangement of the blade shroud and cavity walls.

12 Claims, 2 Drawing Sheets

GAS TURBINE

RELATED APPLICATION

This application claims priority under 35 U.S.C. §119 to European Patent Application No. 10164084.5 filed in Europe on May 27, 2010, the entire content of which is hereby incorporated by reference in its entirety.

FIELD

The present disclosure pertains to a gas turbine with shrouded rotatable blades and a cooling arrangement for cooling of the blade shrouds.

BACKGROUND INFORMATION

Gas turbine rotatable blades of first blade rows of a gas turbine can be designed with a blade shroud at their tips extending circumferentially along a blade row. The blade shroud can limit an amount of working fluid flow leaking through a clearing gap between the blade tips and a flow channel wall and can thereby maximize an effect of the working fluid on the rotatable blades. In first stages of a gas turbine, where temperatures of turbine gases can be at their highest, the rotatable blades can be fully shrouded. The blade shrouds form a continuous ring encompassing the blade tips and an entire circumference of the blade row thereby minimizing the hot gas flow reaching the flow channel walls. A blade shroud can include one or more fins, also known as knife-edges, that extend radially or partially radially away from the shroud and towards a gas turbine stator and flow channel wall.

The stator or inner casing of the turbine forming the flow channel wall includes carriers for vanes as well as thermal heat shields mounted on its inner walls.

The heat shields can protect the wall of the flow channel, or gas turbine inner casing, from the high-temperature gas flow driving the gas turbine and thereby can assure an economical operating lifetime.

The blade shrouds and flow channel wall with heat shields can be actively cooled by cooling flows directed to the shroud and heat shields. EP 1 219 788 for example, discloses a gas turbine with blade shrouds and heat shields that are cooled by a cooling airflow passing through a cooling channel extending through an inner casing and heat shield and leading to a space between two fins of the blade shroud and the heat shield. From that space, the cooling flow passes over the shroud and the fins to both leading and trailing edges of the blade shroud, where it can enter into the hot gas flow of the turbine. The cooling air requires an appropriate pressure level for the cooling flow to reach the leading edge of the shroud by flowing in a direction opposite the direction of the hot gas flow.

EP 2009248 discloses a gas turbine and a cooling arrangement for the cooling of the rotatable blade tips including a cooling flow passage directing a cooling flow to the leading edge of the blade shroud. A leakage flow from the gas turbine flow channel is allowed to reach the exit opening for the cooling passage and mix with the cooling flow emerging from the passage.

SUMMARY

A gas turbine is disclosed, including a rotor rotatable about a rotor axis, rotatable blades mounted on the rotor in circumferential rows, a stator with an inner casing and stationary blades mounted in circumferential rows axially adjacent to the rotatable blades, wherein the inner casing and the rotor define a flow channel with a flow channel wall, and wherein each rotatable blade includes a blade shroud having a fin extending into a circumferentially extending cavity of the inner casing, a cooling arrangement with openings for a cooling flow arranged in a wall of the circumferentially extending cavity in the inner casing, wherein the cooling arrangement includes a protrusion arranged on each rotatable blade shroud and extending away from a leading edge of the respective rotatable blade and into the circumferentially extending cavity of the inner casing, wherein the protrusion extends in a direction dividing a space of the circumferentially extending cavity into a first, radially outer space and a second, radially inner space, where the openings for the cooling flow are arranged within the radially outer space.

DETAILED DESCRIPTION

Figure 1:
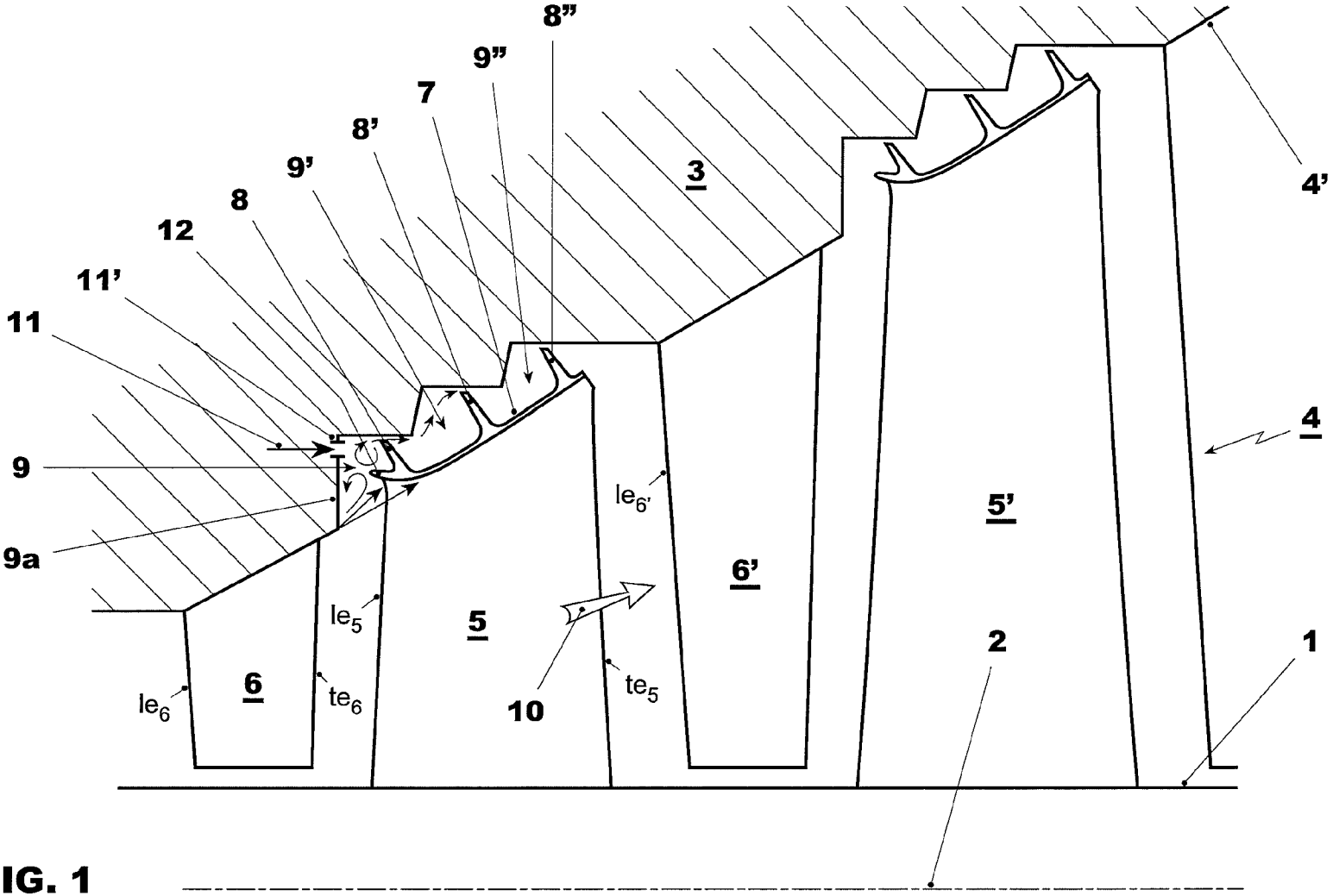
FIG. 1 shows a view of a part of an exemplary embodiment of a gas turbine in a section through an axis of a rotor of the gas turbine including the gas turbine rotor with rotatable shrouded blades and a gas turbine stator arranged about the rotor with stationary blades and a turbine inner casing.

The disclosure relates to a gas turbine having rotatable blades with blade shrouds and a gas turbine stator having heat shields and vane carriers and in particular a cooling arrangement for the rotatable blade shroud by a cooling airflow entering through a heat shield in the stator.

A gas turbine according to an exemplary embodiment of the disclosure includes a rotor rotatable about a rotor axis, a stator or gas turbine inner casing, rotatable blades mounted on the rotor in circumferential rows and stationary blades or vanes mounted in circumferential rows on the stator or inner casing. The rotatable blades each have a leading and a trailing edge and extend radially outward from a blade root to a blade tip. The inner wall of the inner casing and a rotor surface define a gas turbine flow channel for the hot turbine gases to flow and drive the turbine. The wall of the inner casing includes vane carriers and thermal heat shields that can protect it from the hot gases. The stator or inner casing wall includes a contour forming circumferentially extending cavities radially opposite the rotatable blade tips or about the rotatable blade leading and trailing edge or both and into which the rotatable blade shroud extends. Each rotatable blade of the gas turbine includes a blade shroud on its tip having at least one fin, which extends from the shroud towards a circumferential cavity in the stator or inner casing wall. The gas turbine includes a cooling arrangement with openings for a cooling flow arranged in the wall of a circumferentially extending cavity in the inner casing.

According to an exemplary embodiment of the disclosure, the cooling arrangement includes a protrusion on the leading edge of the shroud of the gas turbine blade extending away from the leading edge of the blade and into the circumferential cavity in the inner casing wall having the openings for the cooling flow. In particular, the protrusion extends in a direction dividing the space of the circumferential cavity into a first, radially outer space and a second, radially inner space, where the openings for the cooling flow are arranged within the radially outer space.

The protrusion on the blade shroud can affect a division of the circumferential cavity space between the fin and the inner casing wall into two spaces, where openings in the wall of the circumferential cavity in the inner casing are configured and arranged to allow the cooling fluid flow to enter the radially outer space of the cavity radially outward from the protrusion on the blade shroud. This has an effect such that the cooling fluid flow entering the cavity through the openings in the inner casing wall is separated from the hot gas flow in the turbine flow channel. The first, radially outer space is defined by a cavity wall, the fin on the shroud, and a radially outer surface of the protrusion on the shroud. The second, radially inner space is defined by the radially inner surface of the protrusion and the cavity wall. The division of the cavity space allows the cooling flow entering the cavity to remain within the first, radially outer space and to follow a vortex path therein. This can effect an improved cooling of the shroud and the heat shields on the inner casing. The cooling flow within that first space can continue to flow through a clearing gap between the fin and the radially opposite inner casing wall to portions of the rotatable blade shroud downstream.

The protrusion on the shroud leading edge can reduce and minimize the mixing of the hot gas flow with the cooling flow in the radially outer space. The protrusion on the shroud can have an effect such that the hot gas flow reaching into the radially inner space of the cavity can be largely contained within the radially inner space and limits its entry into the outer space. Instead, the protrusion forces the hot gas flow into a vortex path within the radially inner space, which can further limit its flow through a clearing gap between the protrusion and the cavity wall and into the radially outer space of the cavity. The hot gas flow and the cooling flow, each forced into a vortex, can therefore remain substantially contained such that mixing of the two flows is limited and the temperature of the cooling flow is kept at a lower level. By improving cooling efficiency the operating lifetime of the blade can be extended. In addition, less cooling fluid can be necessary, which improves the efficiency of the gas turbine.

In an exemplary embodiment of the disclosure, the radially inner surface of the protrusion on the shroud extends toward the cavity wall at an angle with respect to the direction of the flow channel wall at the inner casing, where this angle can be within a range from 30° to 60°. This division of the cavity into the two spaces allows an optimization of the radially outer space for the cooling flow and of the effective cooling of the shroud and heat shields In an exemplary embodiment of the disclosure, a degree that the protrusion on the blade shroud extends into the space of the circumferential cavity can be defined by an angle. This angle can be defined by the direction of the flow channel wall and a line of sight from a tip of the protrusion to the radially inner most point of the wall of the circumferential cavity, where the wall of the circumferential cavity meets the trailing edge of the stationary blade adjacent upstream of the rotatable blade. According to an exemplary embodiment, this angle can be within a range from 10° to 40°. The angle range can assure that the hot gas flow along the flow channel wall and in the direction of the blade shroud impinges on the radially inner surface of the shroud protrusion and separates into two flows at the rotatable blade leading edge. Thereby, the vortex flow within the radially inner cavity space is optimally initiated.

The direction of the vortex initiated within the radially inner space is given by, starting at the leading edge of the blade, a first radially outward flow, followed by a flow in an upstream direction relative to the direction of the gas flow in the flow channel, then by a radially inward flow, then by flow in a downstream direction, then again in the radially outward direction. This direction of the vortex flow in turn can contribute to driving the vortex flow in the first, radially outer cavity space. There, the direction of the vortex flow of the cooling flow can be, starting from the entry through the openings in the cavity wall, first in the downstream direction relative to the direction of the main flow in the flow channel, then radially inward, then in the upstream direction, then radially outward, and then again in downstream direction.

In an exemplary embodiment of the disclosure, the protrusion extends at an angle such that it divides the cavity into two spaces each having a radial extension. A ratio of the radial extension of the first, radially outer space to that of the second, radially inner space can be ≥1:4. A line tangent to the outermost tip of the protrusion and extending towards the cavity wall meets the cavity wall of the inner casing at a point considered a point separating the radial outer space from the radial inner space of the cavity. The radial extension of the outer space from this separation point to the radial outer wall of the cavity is at least 25% of the radial extension of the radially inner space. The radial extent of the radially inner space is measured from the separation point to the point, where the cavity wall meets the flow channel wall at the stationary blade adjacent to and upstream of the rotatable blade. The disclosed range of the ratio of the radial extensions of the two spaces can allow sufficient space for the cooling flow to follow its vortex flow and perform an optimized cooling of the shroud and heat shields. It also can allow the hot gas flow near the flow channel wall to effectively enter a vortex flow within the cavity and/or continue in the flow channel along the blade shroud and in the direction of the flow channel wall.

In an exemplary embodiment of the disclosure, an amount the protrusion extends into the cavity of the inner casing can be defined by an angle between the direction of the flow channel wall and a line extending from the outermost tip of the protrusion to the radially inner end of the cavity, where the wall of the cavity meets the flow channel wall at the stationary blade adjacent to and upstream of the rotatable blade.

In an exemplary embodiment of the disclosure, the openings of the cooling arrangement can be arranged within a radially outermost region of the first, radially outer cavity space. Specifically, this region can encompass the radially outermost half of the first, radially outer cavity space.

FIG. 1 shows in a section view an exemplary gas turbine according to the disclosure including a shaft 1 rotatable about a rotor axis 2 and rotatable blades 5 arranged on the shaft 1 in circumferential rows by means of blade roots (not shown). The rotor 1 is enclosed by a stator including an inner casing 3 and stationary blades or vanes 6. The stationary blades or vanes 6 are mounted on the stator in circumferential rows by means of vane carriers, where each row is positioned adjacent a row of rotatable blades 5. The blades 5, 6, 5', 6' have leading edges $le_5$, $le_6$, $le_6$, . . . and trailing edges $te_5$, $te_6$, respectively. The direction of the hot gas flow through the gas turbine is indicated by arrow 10. The inner casing 3 is delimited by an inner casing wall 4', which forms together with the surface of the rotatable shaft 1 the flow channel 4 of the gas turbine. The inner casing wall 4' extends in this sectional view from the rotor axis 2 in the flow channel direction at an angle to the rotor axis and along the contour of the inner casing at the vanes 6, 6'. The inner casing wall 4' can be protected from the hot gas temperatures by thermal heat shielding elements, which are not individually illustrated in detail in these figures. The contour of the channel wall 4' shown may be understood as an exemplary contour of the channel wall including the thermal shielding elements.

In this disclosure, a radially outward direction is defined as the direction radially away from the rotor axis 2, while a radially inward direction is defined as a direction radially toward the rotor axis 2. An axial direction is defined by a direction parallel to the rotor axis 2. An upstream direction is defined as the direction opposite the hot gas flow 10, while a downstream direction is defined as the direction of the hot gas flow 10 itself.

Each rotatable blade 5 of a blade row includes at its tip or radially outer end a shroud 7 having one or more fins 8, 8', 8". The fins extend from the shroud 7 toward the inner casing wall 4'. The contour of the inner casing wall 4' at this location forms circumferential cavities 9, 9', 9", into which extend the fins 8, 8', 8" respectively. The fins limit together with the wall cavities the leakage flows through the clearing gaps between the rotatable blades and the inner casing and thereby increase the power of the turbine. The cavity 9 radially opposite and upstream of the leading edge $le_5$ of the rotatable blade 5 is delimited by a first wall 9*a* extending radially outward from the trailing edge $te_6$ of the stationary blade 6 and a second wall 9*b* extending in an axial direction. The first fin 8 of the shroud 7 extends into this cavity 9. The cavity walls 9*a* and 9*b* form together with the fin 8 the cavity space 9, into which can flow a portion of the hot gas 10 from the flow channel 4. In order to prevent excessive temperatures of the cavity walls and of the shroud 7 in the vicinity of the cavity, the heat shielding elements at the cavity walls includes openings 11' for a cooling flow 10 to enter and cool the shroud and cavity walls.

According to an exemplary embodiment of the disclosure, the shroud 7 includes at its leading edge a protrusion 12 having in its cross-section an elongated shape extending away from the leading edge $le_5$ of the rotatable blade 5 toward the radially extending wall 9*a* of the cavity 9. The protrusion 12 effects a spatial division of the cavity 9 into two spaces, a first, radially outer space between the axially extending cavity wall 9*b* and the protrusion 12 and a second, radially inner space between the protrusion 12 and the cavity wall 9*a* extending to the point, where the cavity wall 9*a* meets the trailing edge $te_6$ of the stationary blade 6 adjacent to the rotatable blade 5.

FIG. 1 shows an exemplary gas turbine according to the disclosure. However, the disclosure can encompass gas turbines with this kind of shape of cavities in the inner casing wall as well as further shapes. Further examples of the disclosure include gas turbines with inner casing walls having cavities opposite from the rotatable blade row, where the cavity walls can have slightly different but essentially similar shapes. Specifically, the cavity walls extending axially can extend exactly axially, however they can also extend partially or substantially axially but in any case away from the direction of the flow channel wall 4'. They can also be understood as having a curved shape. Respectively, the walls extending radially are to be understood to extend either exactly radially, but also partially or substantially radially but in any case away from the direction of the flow channel wall 4'. Again, they can also be understood as having a curved shape.

Figure 2:
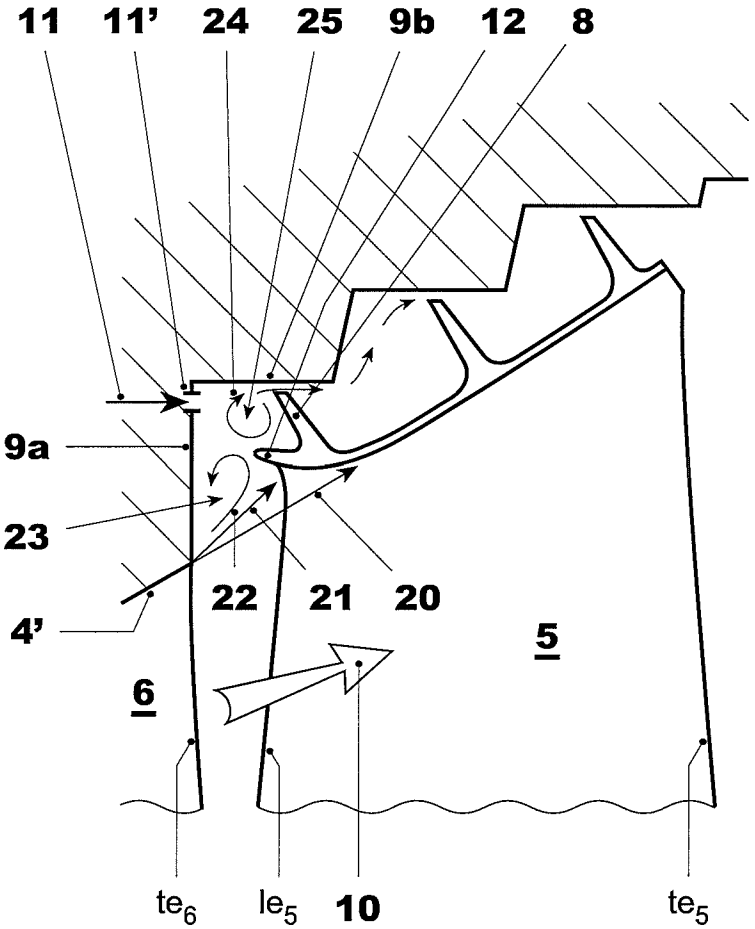
FIG. 2 shows a rotatable shrouded blade of the gas turbine of FIG. 1. It shows, for example, a contour of a cavity at an inner casing wall opposite the rotatable blade shroud and the blade shroud including a protrusion at its leading edge according to the disclosure. Flow paths of the cooling flow and hot gas flow affected by the shroud protrusion are indicated.

FIG. 2 shows in greater detail the shape of the protrusion 12 and in particular the flow paths of the hot gas flow within the cavity 9 and of the cooling flow through the openings 11' in the heat shielding on the inner casing wall 3. The hot gas flow 10 flows along the channel wall 4' and can continue in several directions after it leaves the trailing edge $te_6$ of the stationary blade 6. A portion of the hot gas flow can continue along the rotatable blade shroud 7 as shown by the arrow 20. A further portion of the hot gas flow is diverted from its original direction away from the blade airfoil leading edge $le_5$ and impinges on the shroud 7 of blade 5 in the vicinity of its leading edge as indicated by the arrow 21.

A cooling flow 11, such as air or steam, enters the cavity 9 via the openings 11' in the heat shielding of the cavity walls 9*a* and flows into the first, radially outer space 25 of the cavity 9. Due to the delimitation of the space by the protrusion 12, the cooling flow enters a vortex 24 within that space 25. Due to its vortex flow path, its efficiency to cool the cavity walls and shroud 7 in that region is increased. Some of the cooling flow can flow as a leakage flow through the gap between the fin 8 and the cavity wall 9*b* and reaches into the spaces 9' and 9" between the downstream fins 8, 8', and 8" and can cool the shroud and inner casing walls within these spaces.

A further portion 22 of the hot gas flow 10 entering the cavity 9 is diverted into the second, radially inner space 23. The delimitation of the space 23 by the protrusion 12 forces that hot gas flow into a vortex path 22, whereby the passage of a hot gas flow through the gap between the protrusion 12 and the cavity wall 9*a* and toward the cooling flow 11 can be limited. The direction of the hot gas vortex 22 as indicated in the figure can enforce the formation of the cooling fluid vortex 24. Thus, by the given directions of the two vortices as indicated by the arrows in the figure, the hot gas flow 22 and the cooling flow 25 can remain substantially contained within the spaces 23 and 25, respectively. Thereby, the temperature of the cooling flow can remain at a lower level compared to the case when hot gas flows can mix with the cooling flow. Thus, the cooling efficiency of the cooling of the shroud can be improved.

The protrusion 12 can have a wing-like shape, where the radially inner surface has a curved contour convexly curved toward the turbine's rotor, as shown in the figures. Other shape parameters of the protrusion may be largely determined by manufacturing considerations.

Figure 3:
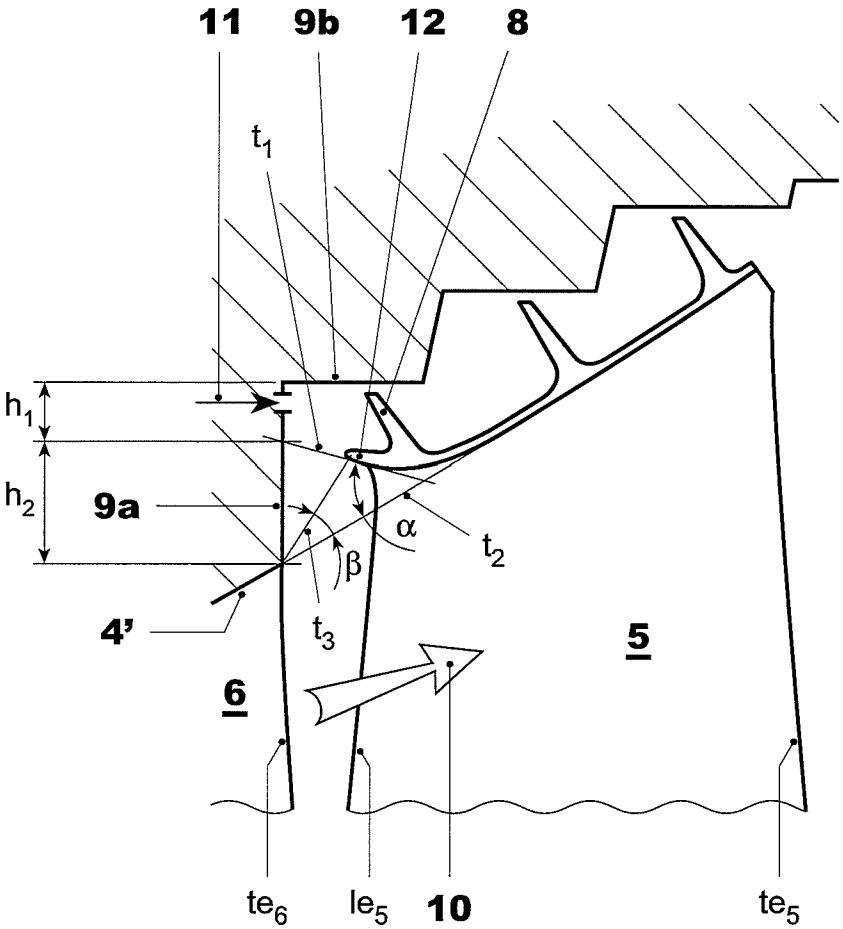
FIG. 3 shows the same partial view of a gas turbine as shown in FIG. 2 and in particular the dimensional details of the shroud protrusion in relation to the cavity in the inner casing wall of the gas turbine.

FIG. 3 shows in greater detail the geometry of the protrusion 12 with respect to the walls 9*a* and 9*b* of the cavity 9 and its degree of extension into the cavity 9.

In an exemplary embodiment of the disclosure, the protrusion 12 of the shroud 7, when viewed in this cross-section of the gas turbine, can be shaped such that a line $t_1$ tangent to its radially inner surface at its outer tip extends at an angle $\alpha$ with respect to the cross-sectional direction $t_2$ of the flow channel wall 4'. The angle $\alpha$ can be within a range from 30° to 60°. The radially inner surface of the protrusion 12 between the leading edge of the blade and its tip can have a curved smooth shape. This shape can provide optimal conditions for the diversion of a hot gas flow reaching into the cavity 9 and forcing it into a vortex flow in the radially inner space 23 of the cavity 9 in the direction as shown in FIG. 2.

In an exemplary embodiment of the disclosure, the degree of the protrusion 12 into the cavity 9 is given by an angle $\beta$ between the direction of the flow channel wall 4' and a line of sight $t_3$ starting from a radial inner most point of the cavity 9 at the trailing edge $te_6$ of stationary blade and ending at the tip of the protrusion 12. This angle $\beta$ can be in a range from 10° to 40° and defines the extent of the protrusion into the cavity and the amount of closure of the gap between the tip of the protrusion and the radially extending cavity wall 9*a*.

The disclosed ranges for the angles $\alpha$ and $\beta$ can assure the formation of the vortices 22 and 24 in the two cavity spaces 23 and 25 and minimization of the hot gas flow mixing with the cooling flow. Thereby they can allow the effective cooling of the shroud and heat shields on the casing walls. Specific angles α and β can be determined within these ranges according to the transient behavior of the gas turbine.

The choice of the angle α determines the relative sizes of the two cavity spaces 25 and 23 generated by the protrusion 12. The greater the angle α, the smaller the size of the radially outer space 25 and the greater the size of the radial inner space 23 will become. In an embodiment of the disclosure, the angle α can be chosen such that the radial extent $h_1$ of the radially outer space 24 can be at least 25% of the radial extent $h_2$ of the radially inner space 24. The distance $h_1$ is given by the radial distance between the point of the intersection of the tangent line $t_1$ at the tip of the protrusion 12 with the radially extending cavity wall 9*a* to the axially extending cavity wall 9*b*. The distance $h_2$ is given by the distance between the intersection point at the radial cavity wall 9*a* and the radially inner most point of the cavity wall 9*a*, where the wall 9*a* meets the trailing edge $te_6$ of the stationary blade 6.

This 25% minimum radial size of the radially outer space 25 relative to the radial size of the radially inner space of the cavity 9 can assure an optimized cooling of the shroud and cavity walls.

In order to allow a further optimization of the cooling efficiency within the radially outer space 25, the openings 11' for the cooling fluid can be positioned in the radially extending cavity wall 9*a* within the radially outer half of that cavity, that is within the radially outer half of $h_1$.

It will be appreciated by those skilled in the art that the present invention embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

TERMS USED IN FIGURES

1 gas turbine shaft
2 rotor axis
3 gas turbine inner casing, stator
4 flow channel
4' inner casing wall, flow channel wall
5, 5' rotatable blades
6, 6' stator, stationary blades
7 rotatable blade shroud
8,8',8" fins
9,9',9" cavities in inner casing
9*a* radially extending cavity wall
9*b* axially extending cavity wall
10 hot gas flow
11 cooling fluid flow
11' openings for cooling fluid
12 protrusion on rotatable blade shroud
$le_5$ leading edge of blade 5
$le_6$ leading edge of blade 6
$te_5$ trailing edge of blade 5
$te_6$ trailing edge of blade 6
20 hot gas flow
21 hot gas flow
22 hot gas flow in vortex
23 radially inner cavity
24 cooling flow in vortex
25 radially outer cavity
26 leakage flow of cooling fluid
α angle between direction of flow channel wall and line tangent to tip of protrusion
β angle between direction of flow channel wall and line through tip of protrusion and point where flow channel wall meets radially extending cavity wall at the stationary blade trailing edge
$h_1$ radial dimension of radially outer cavity from intersection between tangent line to tip of protrusion with cavity wall to axially extending cavity wall
$h_2$ radial dimension of radially inner cavity from intersection between tangent line to tip of protrusion with cavity wall to radially innermost point of cavity
$t_1$ line tangent to protrusion at tip of protrusion
$t_2$ direction of flow channel wall 4'
$t_3$ line from tip of protrusion and radial inner end of the cavity wall

What is claimed is:

1. A gas turbine, comprising:
a rotor rotatable about a rotor axis;
rotatable blades mounted on the rotor in circumferential rows;
a stator with an inner casing and stationary blades mounted in circumferential rows axially adjacent to the rotatable blades, wherein the inner casing and the rotor define a flow channel with a flow channel wall, and wherein each rotatable blade includes a blade shroud having a fin extending into a circumferentially extending cavity of the inner casing;
a cooling arrangement with openings for a cooling flow arranged in a wall of the circumferentially extending cavity in the inner casing, wherein
the cooling arrangement includes a protrusion arranged on each rotatable blade shroud and extending away from a leading edge of the respective rotatable blade and into the circumferentially extending cavity of the inner casing, wherein the protrusion extends in a direction dividing a space of the circumferentially extending cavity into a first, radially outer space and a second, radially inner space, where the openings for the cooling flow are arranged within the radially outer space, wherein
a direction of the flow channel wall forms a second angle with a line of sight extending from an outer tip of the protrusion of the shroud of the rotatable blade to a radially inner most point of the wall of the circumferentially extending cavity in the inner casing, where a wall of the cavity meets a trailing edge of the stationary blade adjacent to the rotatable blade, and where the second angle is substantially from 10° to 40°.

2. The gas turbine according to claim 1, wherein walls of the cavity in the inner casing comprise thermal heat shields.

3. The gas turbine according to claim 1, wherein
the cooling flow entering into the circumferentially extending cavity of the inner casing follows a vortex path in the first, radially outer space and a hot gas flow entering into the circumferentially extending cavity of the inner casing follows vortex flow in the second, radially inner space.

4. The gas turbine according to claim 3, wherein
the cooling flow following the vortex in the first, radially outer space is in a first flow direction path, where starting from the openings in the cavity wall, it first is in a downstream direction relative to a direction of the main flow in the flow channel, then radially inward, then in an upstream direction, then radially outward, and then again in the downstream direction,
and where the cooling flow following the vortex in the second, radially inner space is in a second flow direction path, where starting at the leading edge of the rotatable blade, it is first in a radially outward direction, followed by an upstream direction relative to the direction of the gas flow in the flow channel, then in a radially inward direction, then in a downstream direction, then again in the radially outward direction.

5. A gas turbine, comprising:

a rotor rotatable about a rotor axis;

rotatable blades mounted on the rotor in circumferential rows;

a stator with an inner casing and stationary blades mounted in circumferential rows axially adjacent to the rotatable blades, wherein the inner casing and the rotor define a flow channel with a flow channel wall, and wherein each rotatable blade includes a blade shroud having a fin extending into a circumferentially extending cavity of the inner casing;

a cooling arrangement with openings for a cooling flow arranged in a wall of the circumferentially extending cavity in the inner casing, wherein the cooling arrangement includes a protrusion arranged on each rotatable blade shroud and extending away from a leading edge of the respective rotatable blade and into the circumferentially extending cavity of the inner casing, wherein the protrusion extends in a direction dividing a space of the circumferentially extending cavity into a first, radially outer space and a second, radially inner space, where the openings for the cooling flow are arranged within the radially outer space, wherein the circumferentially extending cavity in the wall of the inner casing comprises a radially extending cavity wall and an axially extending wall, and a line, located at a tangent to a radially inner surface of the protrusion at an outer tip of the protrusion of the blade shroud, intersects the radially extending wall of the cavity at a point, from where there is a first radial distance to the axially extending wall of the cavity and from where there is a second radial distance to a radially inner most point of the circumferentially extending cavity at a trailing edge of a stationary blade adjacent to the rotatable blade, and where a ratio of the first radial distance to the second radial distance is 0.25 or more.

6. The gas turbine according to claim 5, wherein walls of the cavity in the inner casing comprise thermal heat shields.

7. The gas turbine according to claim 5, wherein the cooling flow entering into the circumferentially extending cavity of the inner casing follows a vortex path in the first, radially outer space and a hot gas flow entering into the circumferentially extending cavity of the inner casing follows vortex flow in the second, radially inner space.

8. The gas turbine according to claim 7, wherein the cooling flow following the vortex in the first, radially outer space is in a first flow direction path, where starting from the openings in the cavity wall, it first is in a downstream direction relative to a direction of the main flow in the flow channel, then radially inward, then in an upstream direction, then radially outward, and then again in the downstream direction, and where the cooling flow following the vortex in the second, radially inner space is in a second flow direction path, where starting at the leading edge of the rotatable blade, it is first in a radially outward direction, followed by an upstream direction relative to the direction of the gas flow in the flow channel, then in a radially inward direction, then in a downstream direction, then again in the radially outward direction.

9. A gas turbine, comprising:

a rotor rotatable about a rotor axis;

rotatable blades mounted on the rotor in circumferential rows;

a stator with an inner casing and stationary blades mounted in circumferential rows axially adjacent to the rotatable blades, wherein the inner casing and the rotor define a flow channel with a flow channel wall, and wherein each rotatable blade includes a blade shroud having a fin extending into a circumferentially extending cavity of the inner casing;

a cooling arrangement with openings for a cooling flow arranged in a wall of the circumferentially extending cavity in the inner casing, wherein the cooling arrangement includes a protrusion arranged on each rotatable blade shroud and extending away from a leading edge of the respective rotatable blade and into the circumferentially extending cavity of the inner casing, wherein the protrusion extends in a direction dividing a space of the circumferentially extending cavity into a first, radially outer space and a second, radially inner space, where the openings for the cooling flow are arranged within the radially outer space, wherein the circumferentially extending cavity in the wall of the inner casing comprises a radially extending cavity wall and an axially extending wall, a line, located at a tangent to a radially inner surface of the protrusion at an outer tip of the protrusion of the blade shroud, intersects the radially extending wall of the cavity at a point, from where there is a first radial distance to the axially extending wall of the cavity and from where there is a second radial distance to a radially inner most point of the circumferentially extending cavity at a trailing edge of a stationary blade adjacent to the rotatable blade, and where a ratio of the first radial distance to the second radial distance is 0.25 or more, and the openings for the cooling medium are arranged in the radially extending wall of the circumferentially extending cavity in the inner casing within a region of the axially extending wall of the cavity, where this region extends from the axially extending wall to one half of the first radial distance.

10. The gas turbine according to claim 9, wherein walls of the cavity in the inner casing comprise thermal heat shields.

11. The gas turbine according to claim 9, wherein the cooling flow entering into the circumferentially extending cavity of the inner casing follows a vortex path in the first, radially outer space and a hot gas flow entering into the circumferentially extending cavity of the inner casing follows vortex flow in the second, radially inner space.

12. The gas turbine according to claim 11, wherein the cooling flow following the vortex in the first, radially outer space is in a first flow direction path, where starting from the openings in the cavity wall, it first is in a downstream direction relative to a direction of the main flow in the flow channel, then radially inward, then in an upstream direction, then radially outward, and then again in the downstream direction, and where the cooling flow following the vortex in the second, radially inner space is in a second flow direction path, where starting at the leading edge of the rotatable blade, it is first in a radially outward direction, followed by an upstream direction relative to the direction of the gas flow in the flow channel, then in a radially inward direction, then in a downstream direction, then again in the radially outward direction.

* * * * *